US005213533A

United States Patent [19]

Walden

[11] Patent Number: 5,213,533

[45] Date of Patent: May 25, 1993

[54] ELECTRICAL CONNECTOR BLOCK ASSEMBLY

[75] Inventor: John D. Walden, Mechanicsburg, Pa.

[73] Assignee: Intercon Systems, Inc., Middletown, Pa.

[21] Appl. No.: 872,492

[22] Filed: Apr. 23, 1992

[51] Int. Cl.[5] ..... H01R 13/62

[52] U.S. Cl. ..... 439/372; 439/358

[58] Field of Search ..... 439/345, 350, 357, 372, 439/358

[56] References Cited

U.S. PATENT DOCUMENTS

| | | | |
|---|---|---|---|
| 3,150,906 | 9/1964 | Chambon et al. . | |
| 4,178,051 | 12/1979 | Kocher et al. . | |
| 4,447,101 | 5/1984 | Gugliotti . | |
| 4,480,885 | 11/1984 | Coppelman . | |
| 4,537,454 | 8/1985 | Douty et al. . | |
| 4,579,411 | 4/1986 | Cobaugh et al. | 439/327 |
| 4,842,542 | 6/1989 | Davis | 439/372 |
| 4,941,838 | 7/1990 | Zinn | 439/352 X |
| 5,017,149 | 5/1991 | Hatanaka | 439/157 |

FOREIGN PATENT DOCUMENTS

| | | | |
|---|---|---|---|
| 2208760 | 4/1989 | United Kingdom | 439/372 |

*Primary Examiner*—Neil Abrams
*Assistant Examiner*—Khiem Nguyen
*Attorney, Agent, or Firm*—Thomas Hooker

[57] ABSTRACT

An electrical connector assembly includes a pair of elongate connector blocks with a plurality of terminals in each block, latch members on the ends of one block and a latch assembly on the ends of other block. The latch assemblies include rotary latches and latch operators extending between the rotary latches and the adjacent body. Manual actuation of the operators rotate the latches between opened and closed positions.

18 Claims, 4 Drawing Sheets

ELECTRICAL CONNECTOR BLOCK ASSEMBLY

FIELD OF THE INVENTION

The invention relates to electrical connector assemblies for forming a plurality of electrical connections between circuit elements and particularly to connector block assemblies with mechanical latches for locking the blocks together in the assembled position.

DESCRIPTION OF THE PRIOR ART

Connector block assemblies are conventionally provided with latches or locks to hold the two blocks together in the mated position and prevent accidental disengagement of the blocks due to forces exerted on one of the blocks. It is particularly important to provide a positive latch or lock holding blocks together where one block is connected to a ribbon cable or other flexible member which extends a distance from the block to a remote circuit element and may be subjected to forces tending to separate the block during operation. For instance, connector blocks are commonly mounted on the ends of ribbon cables and mated with other blocks mounted on spaced components to form electrical connections between the components. The components are frequently circuit boards. Inadvertent movement of the cables may stress and unintentionally disengage the blocks. Positive latches prevent disengagement when the blocks are stressed.

In some applications the blocks of a connector assembly are locked together using nut and bolt-type fasteners. In other applications, the blocks are secured together using rotary latches mounted on one block which engage portions of the other block. During engagement of the blocks, the latches are rotated out of the way of the latch surface and then are rotated back under the latch surface to form the desired physical connection between the blocks to prevent accidental disengagement.

Rotary-type latches are conventionally attached to the ends of elongate modern two-block electrical connector assemblies used for forming electrical connections between a number of conductors. Each block in the assembly includes at least one row of contacts which engage the contacts in the other block. Rotary latches mounted on the ends of one block are rotated into and out of engagement with latch surfaces located on the ends of the other block. Conventionally, the cams are manually moved between the open and closed positions in order to lock and unlock the two blocks. Conventional cam handles project an appreciable distance beyond the ends of the blocks in order to provide the required mechanical advantage to facilitate manual rotation of the cams for engaging and disengaging the two blocks and prevent the desired close spacing between the connector assembly and adjacent circuit elements. Further, because the cams are located on the blocks at the level of the meeting contacts, it is necessary to provide space at the ends of the connector assembly for a technician to reach in and manually engage and rotate the latches. Latching and unlatching the blocks are difficult because two hands are required, one hand for each latch. The space required for operating the latches cannot be used to support other circuit elements, thereby wasting space on the board.

SUMMARY OF THE INVENTION

The disclosed connector assembly includes a pair of connector blocks each carrying rows of contacts or terminals engagable with each other. One of the blocks may be mounted on a circuit board and the other of the blocks may be mounted on a ribbon cable for forming electrical connections with a circuit element connected to the remote end of the cable. The block on the cable carries a pair of rotary cam latches located to either end of the rows of contacts for latching engagement with end portions of the block mounted on the circuit board. Spring latch operators are connected to the rotary latches and extend along the ends of block and away from the block on the circuit board. The operators bias the rotary latches to the closed position. The two blocks are assembled by positioning one over the other and pushing the blocks together. The rotary cam latches include beveled surfaces which force the latches out of the way of the latch surfaces during insertion. Additionally, the cam members include follower corners that engage fixed cam surfaces on the board block during insertion to re-rotate the latch fingers back under the latch surfaces thereby assuring positive locking of the latches.

The two spring operators project upwardly away from the ends of the cable block to permit a technician to hold and squeeze both operators together in one hand a distance above the circuit board to rotate the latches to an open position and thereby facilitate disengagement of the two blocks. When released, the resilient latch operators return to their normal position and hold the latches in the locked position to secure the blocks together.

The latch assembly including the rotary latches and operators are more compact than conventional latches which are directly engaged and manually moved between the locked and unlocked positions. This saves space on the circuit board. When the blocks are looked together and the rotary latches are in place to prevent accidental engagement, the latches are flush with the ends of the block assembly thereby permitting visual inspection by a technician to assure proper locked engagement.

Other objects and features of the invention will become apparent as the description proceeds, especially when taken in conjunction with the accompanying drawings illustrating the invention, of which there is one embodiment.

DESCRIPTION OF THE PREFERRED EMBODIMENT

Figure 1:
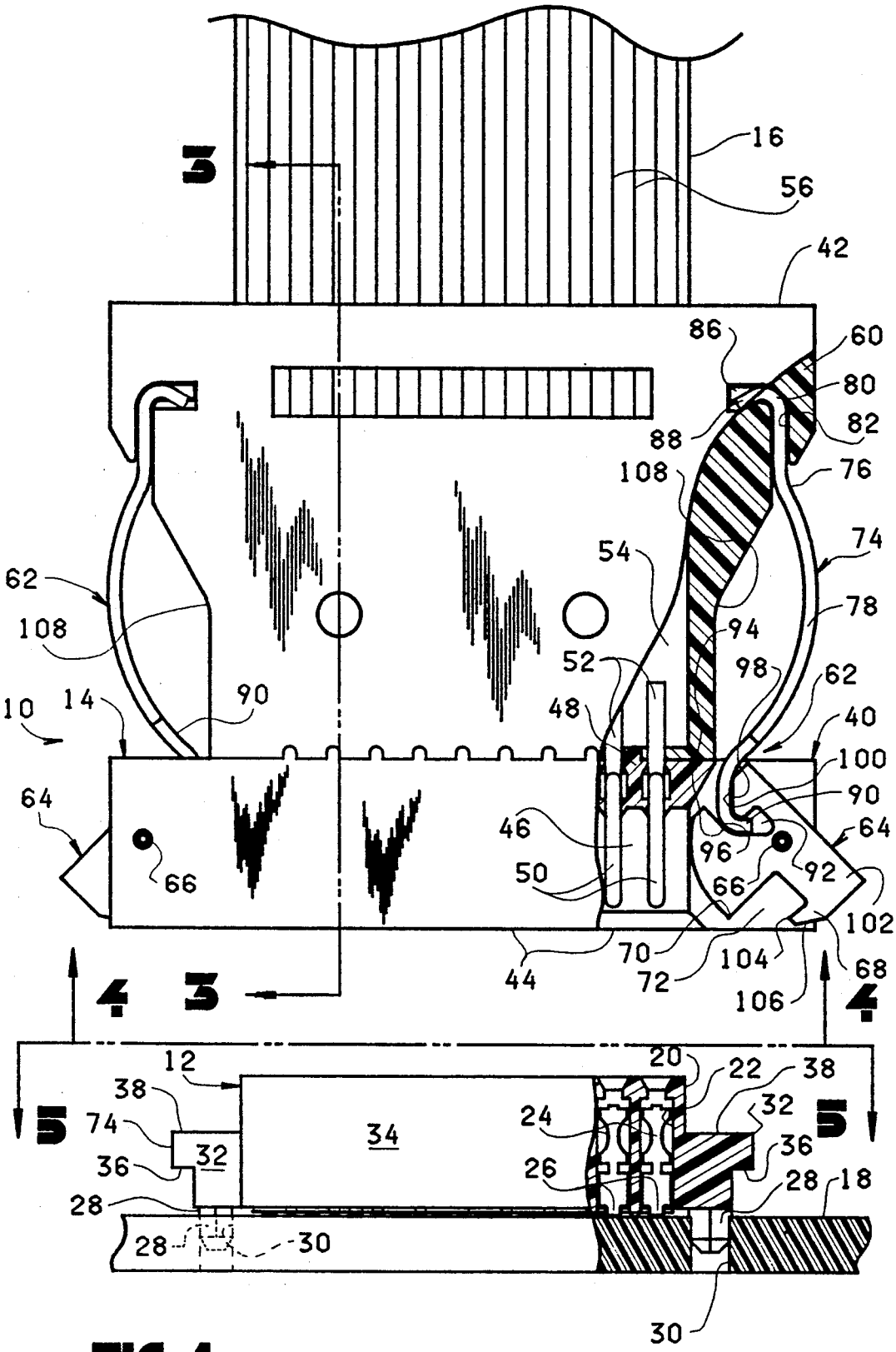
FIG. 1 is a side view, partially broken away, of an electrical connector assembly according to the invention.

Electrical connector assembly 10 includes a female connector block 12 and male connector block 14 and forms electrical connections between conductive lines on a ribbon cable 16 joined to the male block and circuit lines on a circuit board 18 supporting the female block.

The female connector block 12 includes an elongate molded plastic body 20 defining two side-by-side rows of cavities 22 and a plurality of female electrical contacts 24 each located in a cavity. Contacts 24 include tails 26 which extend outwardly of the cavities 22 and are surface-mount bonded to contact pads on the top of board 18. A pair of integral plastic alignment pins 28 extend downwardly from body 20 and into alignment holes 30 in board 18. The pins have a tight fit in the holes and hold the block on the board to locate the tails properly with regard to the contact pads prior to forming electrical connections with the pads. The cavities 22 open on the top of body 20 away from board 18 for reception of male pins carried by block 14.

Like end portions 32 of the elongate block 12 extend beyond cavities 22. These portions are narrower than the body and are located inwardly from opposing body sides 34. Pins 28 are integral with and extend downwardly from portions 32. Latch surface 36 faces board 18 at the outer lower end of each end portion 32 outwardly of pin 28. A cam surface 38 is located on the top of each end portion and extends outwardly from body 20 to the end of the portion.

The male connector block 14 includes a main molded plastic body 40 and an overmolded plastic body 42 joining the main body to cable 16. The main body includes a pair of opposed sidewalls 44 extending the length of the body and defining an interior longitudinal slot 46 between the sidewalls and the top 48 on the body. The slot extends the length of the body. The sidewalls are longer than the top 48 so that the slot 46 is open at the top at both ends of the body 40 above end portions 32 of block 12 as shown in FIG. 1.

Figure 2:
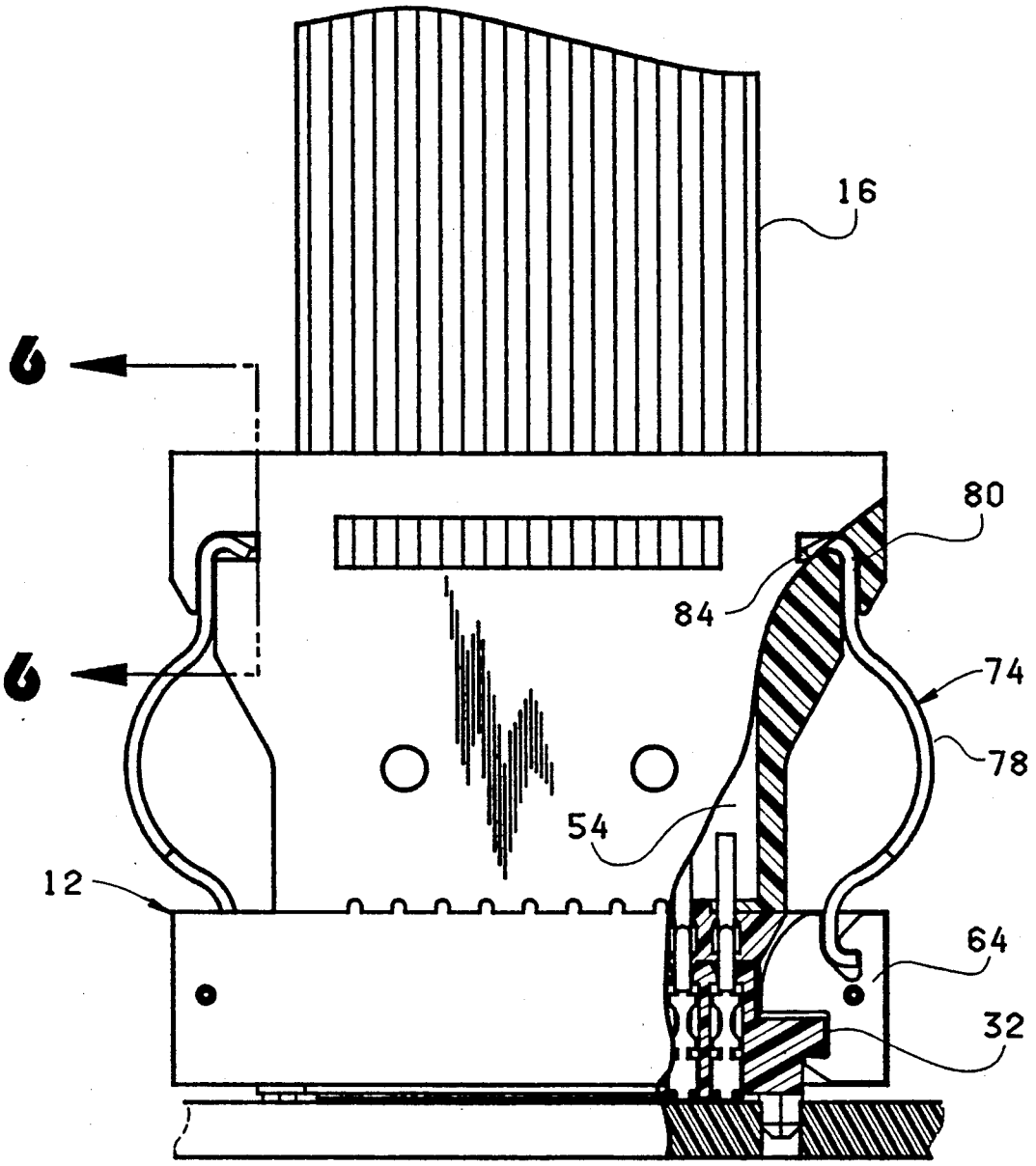
FIG. 2 is a view similar to FIG. 1 showing the blocks in the assembled position.
Figure 3:
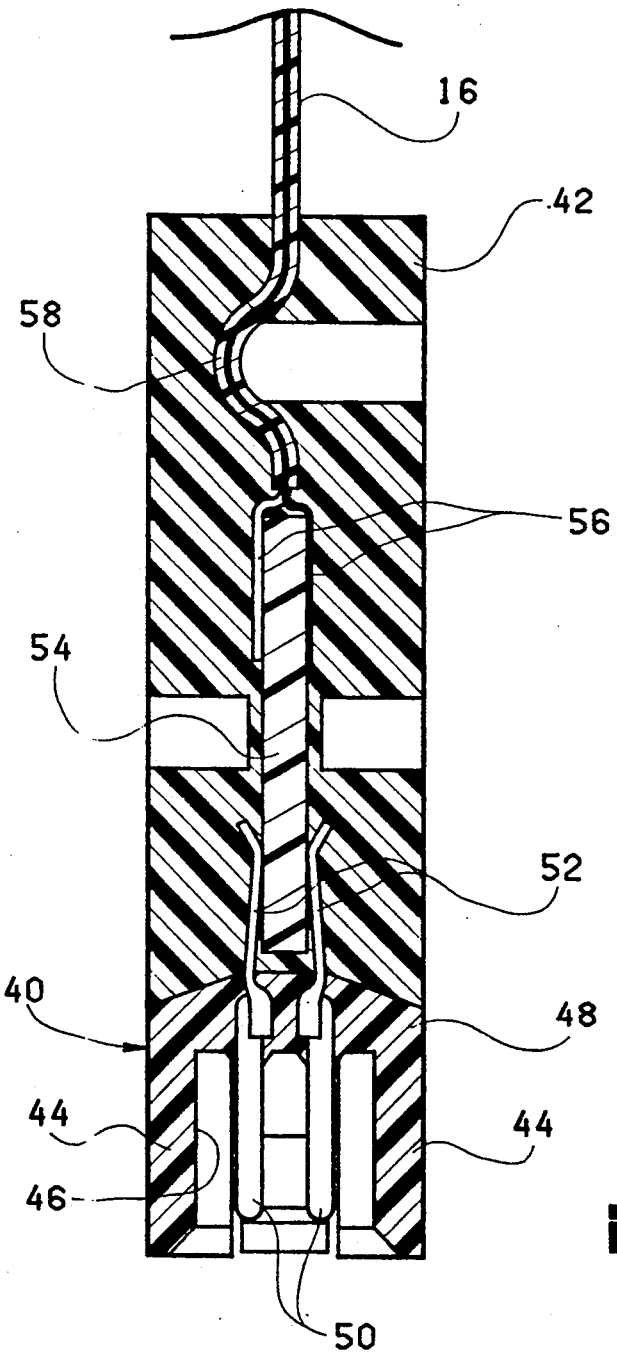
FIG. 3 is a sectional view taken along line 3—3 of FIG. 1.
Figure 4:
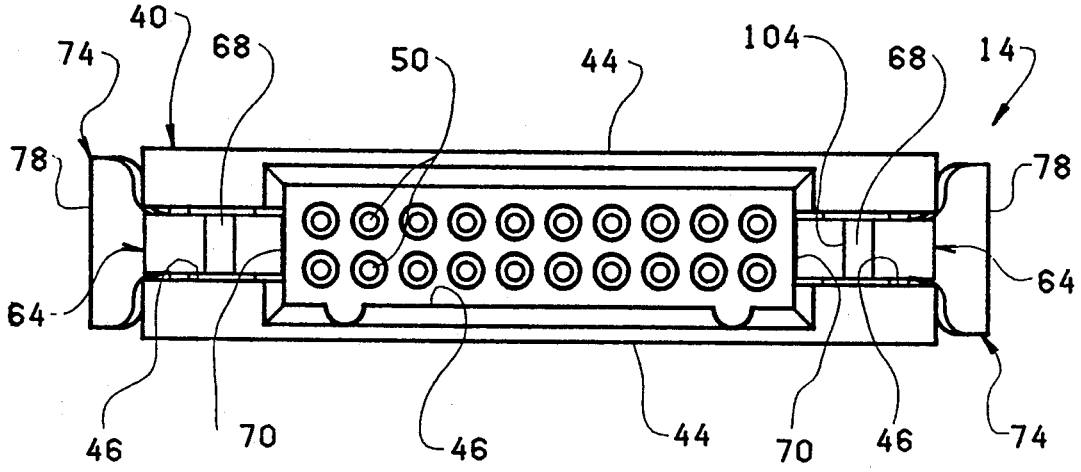
FIG. 4 is a view taken along line 4—4 of FIG. 1 showing the rotary latches in the locked position.
Figure 5:
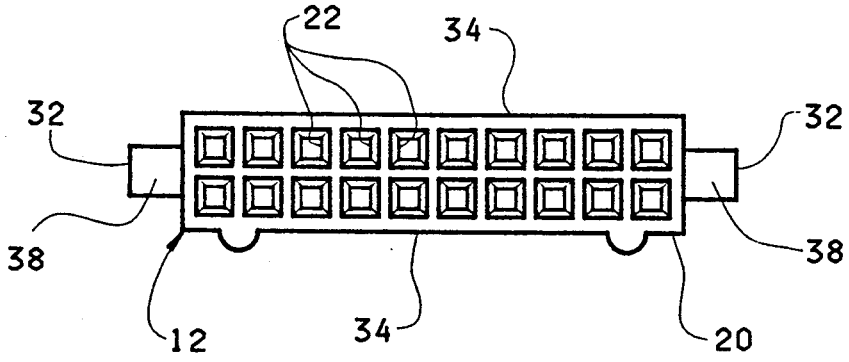
FIG. 5 is a view taken along line 5—5 of FIG. 1.

Two rows of male contact pins 50 are mounted in the top 48 of the body and extend downwardly into slot 46 in alignment with the two rows of female contacts 24 in cavities 22 of block 12. When blocks 12 and 14 are assembled as shown in FIG. 2, the pins 50 extend into the barrels of contacts 24 to form electrical connections therewith Contact strips 52 are joined to pins 50 and extend outwardly from body 40 through top 48 in a direction away from slot 46. These strips form electrical connections with contact lines on flat circuit member 54 located within overmolded body 42 as shown in FIG. 3. The contact leads 56 of cable 16 are electrically joined to the contact lines on member 54 to form electrical connections with pins 50. Member 54 is connected to the cable and the contact arms 52 to form electrical connections with the cable prior to molding of the overmolded body 42. In this way, the plastic in body 42 is integrally bonded to the plastic in body 40 to form connector block 14. During overmolding, a strain relief connection 58 is formed in the portion of the cable molded within the upper end 60 of body 42 located away from body 40.

A latch assembly 62 is located on each end of the male block 12 to secure the two blocks 12 and 14 together when engaged as shown in FIG. 2. Each assembly 62 includes a rotary latch 64 located in the open slot 46 at one end of the main plastic body 40 and a latch operator 74. Each rotary latch 64 is rotatably mounted on a metal pin 66 extending through the member and the ends of sidewalls 44 extending beyond the pins 50 and the top 48 of the body 40. The latch 64 is rotatable on the pin between an open position shown in FIG. 1 and a closed position of FIG. 2. The latch includes a locking finger 68 located below pin 66 and a follower 70 located above and across the width of a recess 72 from the finger 68. The width of the recess 72 is slightly greater than the height of the end portion 32 of body 20 between latch surface 36 and cam surface 38.

Figure 6:
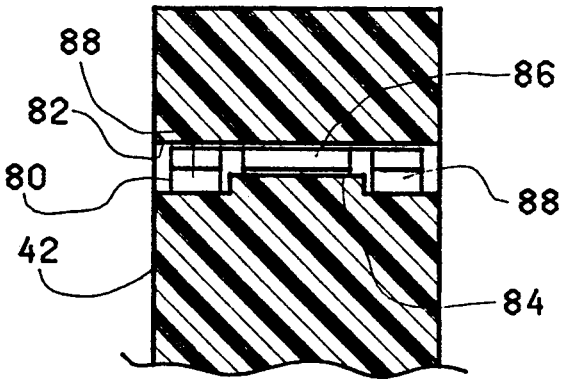
FIG. 6 is a sectional view taken along line 6—6 of FIG. 2.

Each latch assembly 62 also includes a latch operator 74 for rotating the latch 62 from the locked position to the open position. The latch operator 74 comprises a flat stainless steel spring strip 76 located in the space between the latch 64 and the overlying upper end 62 of overmolded body 42. A central manual contact portion 78 is bowed outwardly away from the overmolded body 42 in position for manual engagement by a technician desiring to unlock the latches 64. The L-shaped upper end 80 of operator 74 is fitted within an L-shaped recess 82 extending through the width of the overmolded body 42 as shown in FIG. 1. A projection 84 extends into the bottom of the recess as shown in FIG. 6 to reduce the width of the center of the recess to slightly greater than the thickness of the stock forming strip 76. The width of the ends of the recess 82 adjacent the sides of the overmolding body is approximately twice the width of the metal stock forming the strip. The upper end 80 of the strip 76 is slit to provide a flat central finger 86 and a pair of edge fingers 88. Fingers 88 are bent down from the central figure to either side of the projection 84 to hold the operator in place in block 14.

Operator 74 has a uniform width from upper end 80 through bowed contact portion 78 to a reduced width curved lower end 90. End 90 is fitted within curved slot 92 extending through the width of the rotary latch 64. The end forms a cam for rotating the rotary latch from the closed to the open position and also a stop for preventing over-rotation of the latch. Convex cam surface 94 on end 90 faces inwardly toward the pins 50 and is engagable with curved follower surface 96 on the inner surface of slot 92. Outwardly facing stop surface 98 on the outer side of the lower end 90 is engagable with surface 100 on the side of the slot 92 away from follower surface 96 when the latch has been fully rotated to the open position as shown in FIG. 1. With the latch 64 in the open position the end 102 of the latch extends outwardly beyond the ends of the sidewalls 44 for visual inspection by a technician to determine that the blocks are not properly latched. The spring resiliency of the operators 74 normally biases the latches to the closed or locked positions of FIG. 2. Slot 92 and end 102 of the latch are located on opposite sides of the hinge pin 66 so that outward movement of the slot moves the finger in under the end portion.

The blocks 12 and 14 are mated by positioning the blocks as shown in FIG. 1 with each pin 50 in block 14 located above a female contact 24 located in a recess 22 of block 12. The latches are held in the closed position of FIG. 2 by the spring operators 74. The two blocks are engaged by pushing block 14 down onto block 12 so that the pins 50 extend into the cavities 22 and establish electrical connections with the contacts 24. As block 14 is moved into engagement with block 12 the beveled cam surfaces 106 on the lower ends of locking fingers 68 engage the upper corners of end portions 32 to rotate the latches 64 outwardly of the end portions and permit movement of the blocks 12 and 14 to the fully engaged position of FIG. 2. During the outward camming of the fingers 68, rotation of the latches 64 moves the latch operators into the recess 108 formed between bodies 40 and 42 and compresses the latch operators. As the two locks move together, follower corners 70 on latches 64 engage cam surfaces 38 on the tops of portions 32 to assure return rotation of the latches about pins 66 so that ends 102 are moved back into slots 46 and the locking fingers 68 on the ends 102 are brought under the latch operator as shown in FIG. 2. In this position the latches are flush within the ends of slot 46. Spring operators 74 hold the latches 64 in the locked position. The surface of fingers 68 facing slot 72 are undercut so that any withdrawal force applied to block 14 when the latches 64 are closed brings tip 104 into engagement with latch surfaces 36 and does not cam open the latches. The lower end 90 of the latch operator 74 moves freely in slot 92 during rotation of the latches.

The rotary latches 64 are moved from the locked to the open positions to facilitate disengagement of blocks 12 and 14 by manually pushing the two bowed contact portions 78 into recesses 108 and toward the overmolded body 42. This movement of the contact portions 78 is easily done by gripping the contact portions in one hand and squeezing the contact portions together. The force applied to the latch operators pivots the lower ends 90 inwardly so that the cam surfaces 94 engage follower surfaces 96 on the slots 92 and rotate the latches to move fingers 68 out from under the end portions 32. Rotation of the latches is limited when surface 100 of slot 92 hits the stop surface 98 as shown in FIG. 1. Rotation of the latch 64 beyond the sidewalls 44 is sufficient to assure that the finger 68 is clear of the latch operator 74 without occupying appreciable additional space laterally of the body.

When the latch operators 74 are squeezed together to rotate the latches 64 as described, the corners 70 are rotated down into engagement with surfaces 38 to force block 14 apart from blocks 17 and, ultimately, separate the blocks. The engagement between the corners 70 and surfaces 38 occurs after the fingers 68 have been moved out from under latch surfaces 36. When the contact portions 78 are released, the resiliency of strips 76 rerotates the latches 64 back to the lock position shown in FIG. 2.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. A connector block for an electrical connector assembly including a first block body, a plurality of contact terminals mounted in the body and a latch assembly, the latch assembly including:

a. a first latch having a latch finger, a connection movably mounting the latch on the first body for movement between latched and open positions, and a cam surface on the first latch; and b. an elongate first latch operator for moving the first latch between such positions, the latch operator having a movable first end, such end including a cam engaging the cam surface, a second end connected to the first body a distance away from the contact terminals and a contact portion located between such ends.

2. A connector block as in claim 1 including a spring normally biasing the latch toward the latched position.

3. A connector block as in claim 2 wherein the spring forms part of the latch operator.

4. A connector block as in claim 3 wherein the connection rotatably mounts the first latch on the first body adjacent the contact terminals, and the second end of the latch operator is connected to the first body a distance from the contact terminals.

5. A connector block as in claim 4 wherein said first body is elongate, said contact terminals extend along the length of the block body and the first latch and first latch operator are located on one end of the body; and including a second latch and a second latch operator like said first latch and said first latch operator, located on the other end of the body, said first and second operators each being outwardly bowed away from the body.

6. A connector block as in claim 4 wherein said contact portion is made of a resilient material so that engagement of the contact portion flexes the operator to rotate the first latch from the latched position to the open position.

7. A connector block as in claim 6 wherein said first body includes a recess adjacent the contact portion to permit flexing of the contact portion into the recess.

8. A connector block as in claim 6 including a slot formed in the first latch, the first end of the last latch operator extending into the slot; said a cam surface facing one side of the slot and including a stop surface facing the other side of the slot.

9. A connector block as in claim 6 wherein the first latch includes a recess, said latch finger being located on one side of the recess, follower means on the other side of the recess for both rotating the first latch to the closed position upon engagement of the connector block with another connector block and for partially disengaging the connector block from the other connector block when the first latch operator is moved.

10. A connector block as in claim 6 wherein said latch operator comprises a spring metal strip, said strip being normally bowed outwardly from said recess.

11. A connector block as in claim 1 wherein said connection rotatably mounts the latch on the first body.

12. A connector block as in claim 11 wherein the latch finger is located on the latch to one side of the rotary connection and the cam surface is located on the latch on the opposite side of the rotary connection.

13. An electrical connector assembly including first and second elongate connector blocks, each connector block having a plurality of terminals mounted on and spaced along the block so that the connector blocks may be moved together in parallel overlying relation with pairs of terminals on the different blocks in electrical connection, end portions on the ends of a first connector block, each end portion including a cam surface facing the second connector block and a latch surface facing away from the second connector block, and latch assemblies on the ends of the second connector block, each latch assembly including a latch, a rotary connection mounting the latch on the second connector block adjacent an end portion of the first connector block, each latch including a locking slot with a latch finger on one side of the locking slot engagable beneath an adjacent latch surface and a follower on the other side of the slot engagable with an adjacent cam surface, and an elongate flexible latch operator for rotating the latch about said connection, the latch operator extending from the latch in a direction away from the first connector block and including a first end connected to the latch, a second end connected to the other connector block at a distance spaced away from the latch and a contact portion located between said ends.

14. An electrical connector assembly as in claim 13 wherein said contact portions are resilient and are bowed outwardly away from said other body, and including recesses in said other body adjacent such portions.

15. An electrical connector assembly as in claim 13 wherein each latch operator comprises a resilient metal strip, the first end of such strip extending into and being movably confined within a strip slot in the latch, the second end of the strip extending into a slot in the other body and the contact portion of the strip being normally located a distance outwardly from the adjacent side of the other connector block.

16. An electrical connector assembly as in claim 15 including slots formed through the ends of said other connector block, said latches being located within said slots and pins extending through the latches and the ends of the other connector block, said locking slot being formed in each latch on the side thereof adjacent the first connector block and said first end of the latch operator engaging the latch on the side thereof away from said first connector block.

17. An electrical connector assembly as in claim 15 wherein the slot in each latch includes a cam surface adjacent the other connector block and a stop surface away from the other connector block.

18. An electrical connector assembly as in claim 14 including recesses in said other connector block adjacent the contact portions of each latch operator.

* * * * *

UNITED STATES PATENT AND TRADEMARK OFFICE

CERTIFICATE OF CORRECTION

PATENT NO. : 5,213,533

DATED : May 25, 1993

INVENTOR(S) : John D. Walden

It is certified that error appears in the above-indentified patent and that said Letters Patent is hereby corrected as shown below:

Column 2, line 39, change "looked" to --locked--.

Claim 8, column 6, line 26, change ";" to --,-- and delete "a".

Signed and Sealed this

Fourteenth Day of December, 1993

*Attest:*

BRUCE LEHMAN

*Attesting Officer*

*Commissioner of Patents and Trademarks*